United States Patent [19]

Koji et al.

[11] Patent Number: 5,020,489

[45] Date of Patent: Jun. 4, 1991

[54] INTERCONNECTION ARRANGEMENT FOR DIESEL ENGINE PREHEATING APPARATUS

[75] Inventors: Hatanaka Koji; Aota Takashi, both of Saitama, Japan

[73] Assignee: Jidosha Kiki Co., Ltd., Japan

[21] Appl. No.: 468,403

[22] Filed: Jan. 22, 1990

[30] Foreign Application Priority Data

Feb. 13, 1989 [JP] Japan ..... 1-14590[U]

[51] Int. Cl.[5] ..... F02B 9/08; F23Q 7/22

[52] U.S. Cl. ..... 123/145 A; 123/145 R; 219/270

[58] Field of Search ..... 123/145 A, 145 R; 219/270, 501, 553

[56] References Cited

U.S. PATENT DOCUMENTS

| | | | |
|---|---|---|---|
| 4,661,686 | 4/1987 | Yokoi et al. | 219/270 |
| 4,806,734 | 2/1989 | Masaka et al. | 123/145 A |
| 4,874,923 | 10/1989 | Hatanaka et al. | 219/270 |
| 4,914,751 | 4/1990 | Masaka et al. | 219/270 |
| 4,929,813 | 5/1990 | Masaka et al. | 123/145 A |
| 4,931,619 | 6/1990 | Ogata et al. | 123/145 A |

FOREIGN PATENT DOCUMENTS

| | | | |
|---|---|---|---|
| 58-140476 | 8/1983 | Japan | 123/145 A |
| 62-148869 | 9/1987 | Japan | 123/145 A |
| 63-19740 | 6/1988 | Japan | 123/145 A |
| 63-30061 | 8/1988 | Japan | 123/145 A |
| 63-201425 | 8/1988 | Japan | 123/145 A |

*Primary Examiner*—Raymond A. Neill

*Attorney, Agent, or Firm*—Townsend & Townsend

[57] ABSTRACT

A diesel engine preheating apparatus connects a plurality of glow plugs arranged in corresponding cylinder chambers of a multicylinder diesel engine in series or parallel with or in series and parallel with a power source. The glow plugs are selected from body-grounded type unipolar and bipolar glow plugs. The bipolar glow plug selected from the diesel engine glow plugs includes first and second external connecting terminals which are respectively connected to thin-walled portions of first and second terminal connecting plates located on substantially the same plane. The thin-walled portions interpose an insulating member therebetween, are located at opposite surface sides, and are provided with portions which do not overlap each other when viewed from an upper surface.

8 Claims, 5 Drawing Sheets

INTERCONNECTING ARRANGEMENT FOR DIESEL ENGINE PREHEATING APPARATUS

BACKGROUND OF THE INVENTION

The present invention relates to an improvement in a preheating apparatus having a plurality of glow plugs for respectively preheating subcombustion or combustion chambers (to be referred to as cylinder chambers hereinafter) of a multicylinder diesel engine.

Conventional diesel engine glow plugs constituting preheating apparatuses of this type have various structures including a sheath type glow plug. In these apparatuses, various methods and structures for connecting a plurality of glow plugs have been utilized. However, since the glow plugs are arranged in a narrow space in an engine room of a motor vehicle, satisfactory methods and structure have not been proposed yet.

SUMMARY OF THE INVENTION

It is a principal object of the present invention to provide a preheating apparatus for a glow plug having a simpler wiring structure than that of a conventional glow plug.

It is another object of the present invention to provide a preheating apparatus for a glow plug having a compact wiring structure so as to effectively utilize a space when the preheating apparatus is mounted in a motor vehicle.

In order to achieve the above objects of the present invention, there is provided a diesel engine preheating apparatus in which a plurality of glow plugs arranged in corresponding cylinder chambers of a multicylinder diesel engine are connected in series or parallel with or in series and parallel with a power source, the glow plugs being selected from body-grounded type unipolar and bipolar glow plugs, wherein the bipolar glow plug selected from the diesel engine glow plugs includes first and second external connecting terminals which are respectively connected to thin-walled portions of first and second terminal connecting plates located on substantially the same plane, the thin-walled portions interposing an insulating member therebetween, being located at opposite surface sides, and being provided with portions which do not overlap each other when viewed from an upper surface.

DESCRIPTION OF THE PREFERRED EMBODIMENTS

Figure 1:
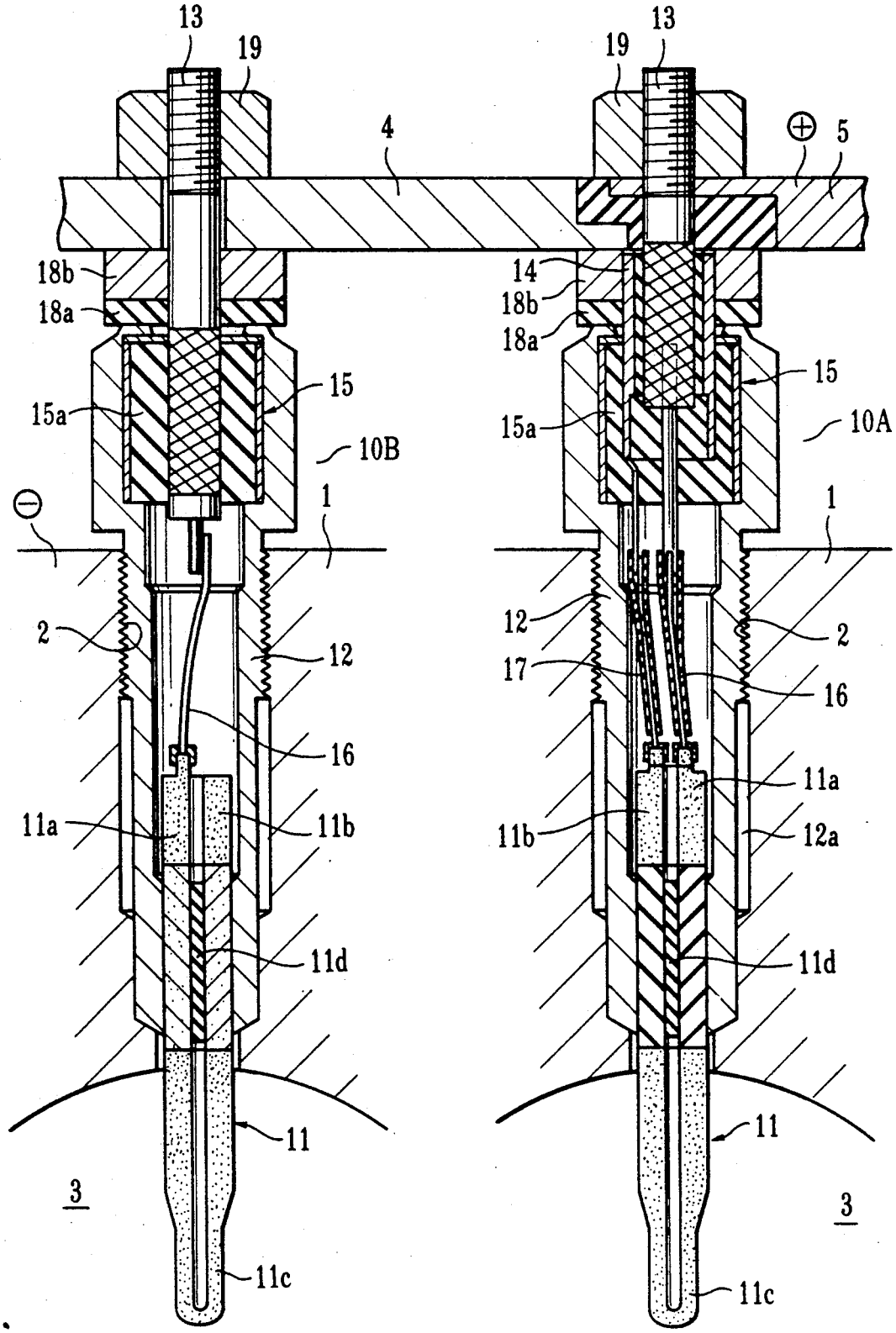
FIG. 1 is an enlarged sectional view showing a main part of a diesel engine preheating apparatus according to an embodiment of the present invention.

FIGS. 1 to 6 show a diesel engine preheating apparatus according to an embodiment of the present invention. Schematic structures of glow plugs 10A and 10B in FIG. 1 will be briefly described below. The glow plug 10A illustrated on the right side in FIG. 1 comprises a rod-like ceramic heater 11, the front end of which serves as a heating element, and a metal tubular holder 12 for holding the heater 11 at its front end. A terminal assembly 15 obtained by embedding first and second external connecting terminals 13 and 14 in an insulating material such as a synthetic resin material which is fitted and held in a rear end portion of the holder 12. The terminals 13 and 14 are respectively connected to lead portions 11*a* and 11*b* of the heater 11 through flexible metal conductors 16 and 17 such as flexible wires. The heater 11 is made of a resistive ceramic material. Reference numeral 12*a* denotes a threaded portion formed on the outer circumferential surface of the holder 12. The threaded portion 12*a* is threadably engaged with a screw hole 2 formed in a corresponding cylinder head 1 of the engine. The front end of the heater 11 extends into the subcombustion (or combustion) chamber 3.

The terminal assembly 15 comprises the first external connecting terminal 13 having an internal front rod portion coaxially connected to the conductor 16, the cylindrical second external connecting terminal 14 which is disposed to surround the first external connecting terminal 13 with a predetermined gap and a lead piece of which extends from the front end and is connected to the conductor 17, and a resin-molded assembly main body 15*a* which insulates the terminals 13 and 14 and has an insulating layer thereon. A metal pipe for reinforcing coupling is fitted on the main body 15*a*.

Reference numerals 18*a* and 18*b* respectively denote an insulating ring and a metal washer which are fitted on the second terminal 14 extending backward from the holder 12. The metal washer 18*b* is electrically and mechanically connected to the second external connecting terminal 14 by insertion under pressure. A terminal connecting plate 4 made of a conductive material (to be described later) is brought into contact with the metal washer 18*b* to achieve an electrical connection. Reference numeral 19 denotes a fastening nut threadably engaged with an external end of the first external connecting terminal 13. The fastening nut 19 electrically connects the first terminal 13 and a second terminal connecting plate 5 (to be described later).

In the glow plug 10A described above, the ceramic heater 11 held at the front end portion of the holder 12 consists of a substantially U-shaped member obtained such that the pair of lead portions 11*a* and 11*b* extending from the two ends of a U-shaped heating element 11*c* backward to be parallel to each other are made of a resistive ceramic material such as SiAlON. The ceramic heater 11 is bonded and held in the front end portion of the holder 12 through insulating coating layers as insulating layers formed on the outer surfaces of the lead portions 11*a* and 11*b*. Reference numeral 11*d* denotes an insulating sheet made of an insulating ceramic material formed integrally in a holding portion of the holder 12 in a slit between the lead portions 11*a* and 11*b*.

The glow plug 10B illustrated on the left side in FIG. 1 comprises a body-grounded unipolar glow plug in which the cylindrical second external connecting terminal 14 of the terminal assembly 15 in the bipolar glow plug 10A is omitted, and one lead portion 11*b* of the heater 11 is electrically connected to a holder 12. The holder 12 threadably engaged with an engine head 1 is electrically connected thereto. Other arrangements of the glow plug 10B are substantially the same as those of the glow plug 10A. The same reference numerals as in the glow plug 10A denote the same parts in the glow plug 10B, and a detailed description thereof will be omitted.

Figure 2:
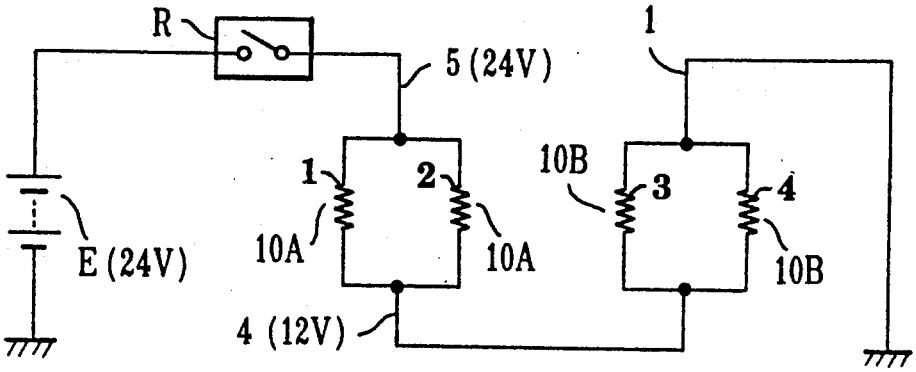
FIG. 2 is a circuit diagram of an overall circuit arrangement of the diesel engine preheating apparatus shown in FIG. 1.
Figure 3:
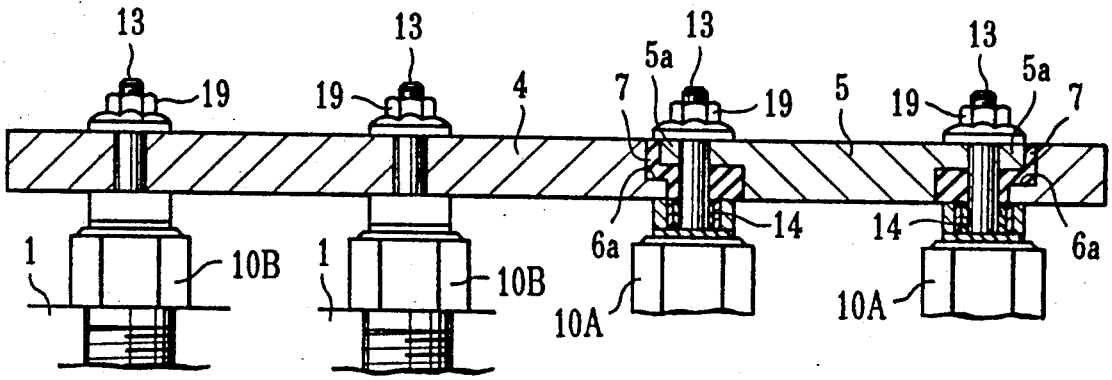
FIG. 3 is a sectional view showing a main part for explaining a terminal connecting structure of the preheating apparatus shown in FIG. 1.
Figure 4A:
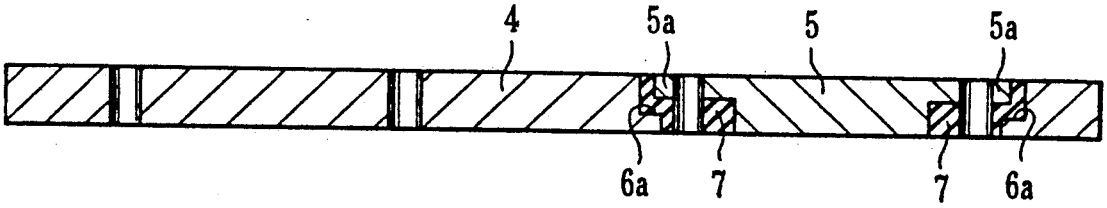
FIGS. 4A and 4B are a sectional view and a plan view, respectively, showing a terminal connecting plate structure.
Figure 4B:
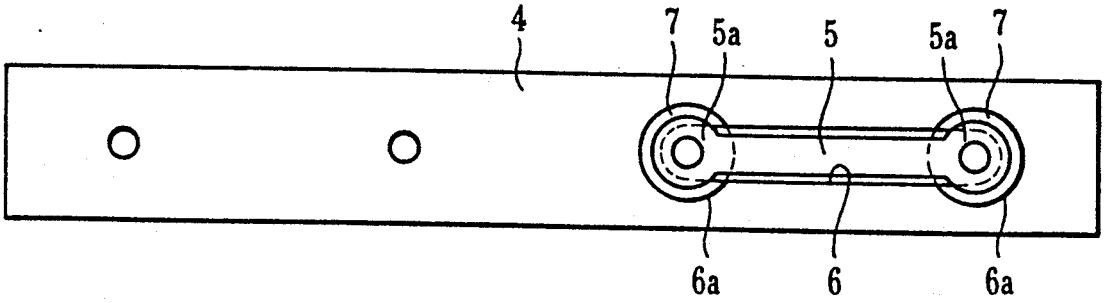
Figure 5:
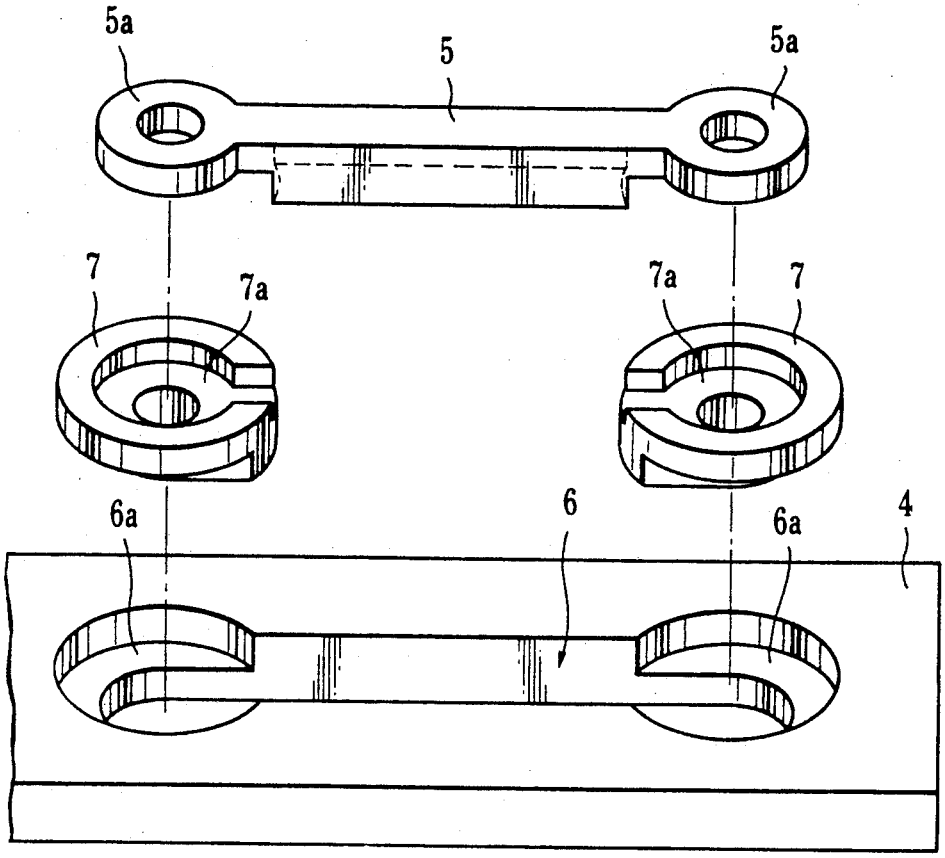
FIG. 5 is a schematic perspective view showing the terminal connecting plate structure.
Figure 6:
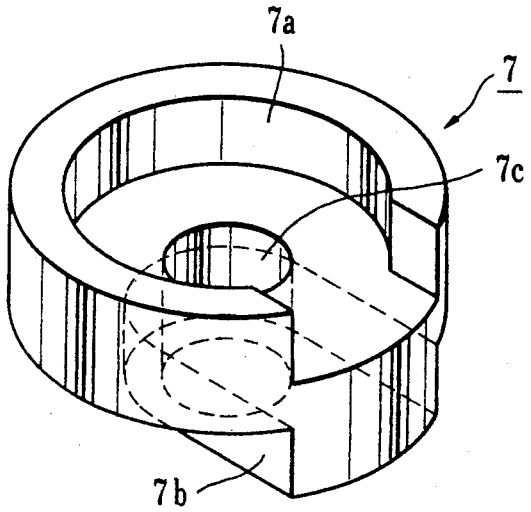
FIG. 6 is a schematic perspective view of an insulating member.

According to the characteristic feature of the present invention, as is apparent from FIG. 2, the bipolar glow plugs 10A and the unipolar glow plugs 10B have a rated voltage of 12 V half a predetermined voltage (24 V in this embodiment) of a battery E. At least two parallel-connected glow plugs 10A are connected in series with at least two parallel-connected glow plugs 10B. FIG. 2 shows four glow plugs ① to ④ attached to a 4-cylinder diesel engine and connected as described above. The upstream glow plugs ① and ② may comprise bipolar glow plugs. It is read understood that the remaining glow plugs ③ and ④ may be unipolar glow plugs 10B or the bipolar glow plugs 10A. It is essential that the pair of parallel-connected glow plugs 10A and the pair of parallel-connected glow plugs 10B are connected in series with the battery E. With this arrangement, a glow plug having a rated voltage (12 V in this embodiment) half the voltage of the battery E can be used. Reference numeral R denotes a relay arranged in the circuit of the preheating apparatus.

With the above arrangement, the ceramic heaters 11 of the glow plugs 10A and 10B are made of resistive SiAlON as a resistive ceramic material to produce glow plugs having a rated voltage of 12 V which allows a high product yield, and this 12-V glow plug can be used for a 24-V battery. A conventional manufacturing problem posed by variations of resistance values at room temperature during formation of 24-V ceramic heaters 11 can be solved. In addition, the common 12-V glow plugs can be used for 12-and 24-V applications. Therefore, a lot of practical advantages can be obtained such that a mass production effect can be improved, the manufacturing cost can be reduced, and management of components can be facilitated.

In this embodiment, the plurality of glow plugs 10A and 10B are connected by the terminal connection structures shown in FIGS. 3 to 6, and the prescribed parallel and series connections of the glow plugs 10A and 10B can be achieved by a simple structure which does not have any spatial problem. This will be briefly described below. The external connecting terminal 13 of the body-grounded glow plug 10B located on the downstream side of the circuit extends through the terminal connecting plate 4 made of a conductive material and attached along the outer surface of the corresponding engine head 1. The glow plug 10B is then fixed by the fastening nut 19 and the like. At the same time, the front end portion of the glow plug 10B is threadably engaged with the engine head 1 and extends therein, and the front end portion of the glow plug 10B opposes the combustion chamber 3 or the like. The glow plug 10B is grounded through the holder 12 engaged with the head 1.

Through grooves 6 having thin-walled stepped holding portions 6*a* are formed at both end portions of the terminal connecting plate 4. The second terminal connecting plate 5 made of a conductive material is insulated from and fitted in the terminal connecting plate 4. In this case, the second connecting terminal 5 also has thin-walled portions 5*a*. These thin-walled portions 5*a* are formed on surfaces which oppose the thin-walled portions 6*a* of the second connecting terminal 4. These thin-walled portions have nonoverlapping portions. Insulating members 7 have holding portions 7*a* for holding the thin-walled end portions 5*a* of the second terminal plate 5 while the holding portions 7*a* are placed on the thin-walled holding portions 6*a* of the terminal connecting plate 4 and are insulated from the terminal connecting plate 4. Each holding portion 7 has a projection 7*b* extending from its lower portion and opposing the other end of the terminal connecting plate 4 through the corresponding through groove 6. A hole 7*c* is formed in each holding portion 7, and the first external connecting terminal 13 of the glow plug 10A extends through the hole 7*c*.

With this structure, one (10A) of at least two glow plugs 10A and 10B connected in parallel with the engine head 1 is constituted by a bipolar structure having the first and second external connecting terminals 13 and 14 at its rear end side while the rear-side external connecting terminals 13 are respectively held by the terminal connecting plates 4 and 5 made of a conductive material. This first external connecting terminal 13 is connected to the corresponding second terminal connecting plate 5 integrally assembled to the terminal connecting plate 4 through the insulating members 7 and connected to the battery E. At the same time, the second terminal connecting terminal 14 is connected to the terminal connecting plate 4 through the metal washer 18*b* and the like. The one (10A) of the glow plugs 10A and 10B is connected in series with the other glow plug (10B) connected to the external connecting terminal 13 through the terminal connecting plate 4. Note that the first and second connecting plates 4 and 5 are connected through the insulating members 7 on the same plane in this embodiment.

With the above structure, in a large vehicle which uses a 24-V battery, glow plugs 10A and 10B having 12-V ceramic heaters 11 which can be easily manufactured with high precision can be used. The performance of the glow plugs can be enhanced, and at the same time, a simple, low-cost wiring structure can be employed. In addition, no problem of a mounting space is posed.

The wiring connection structure is not limited to the ceramic heater 11 made of resistive SiAlON. It is readily understood that the present invention is also applicable to a sheath or another type ceramic heater to obtain the same effect as described above.

Figure 7:
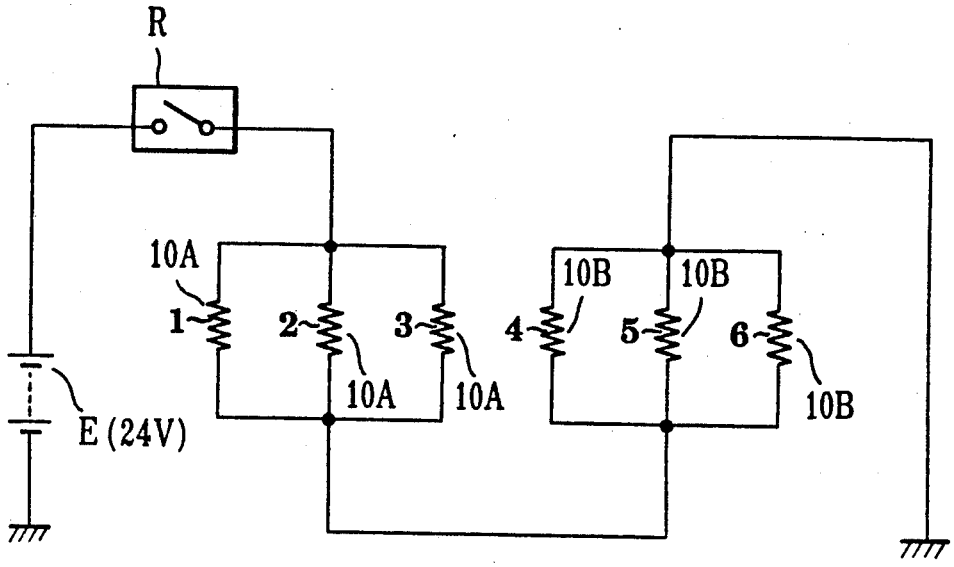
FIGS. 7 and 8 are circuit diagrams showing other embodiments of the present invention.
Figure 8:
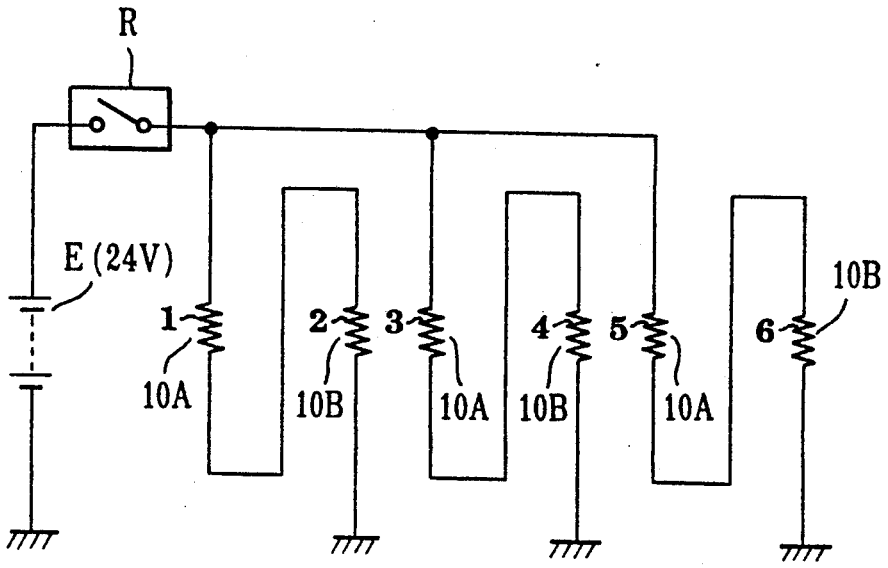
Figure 9:
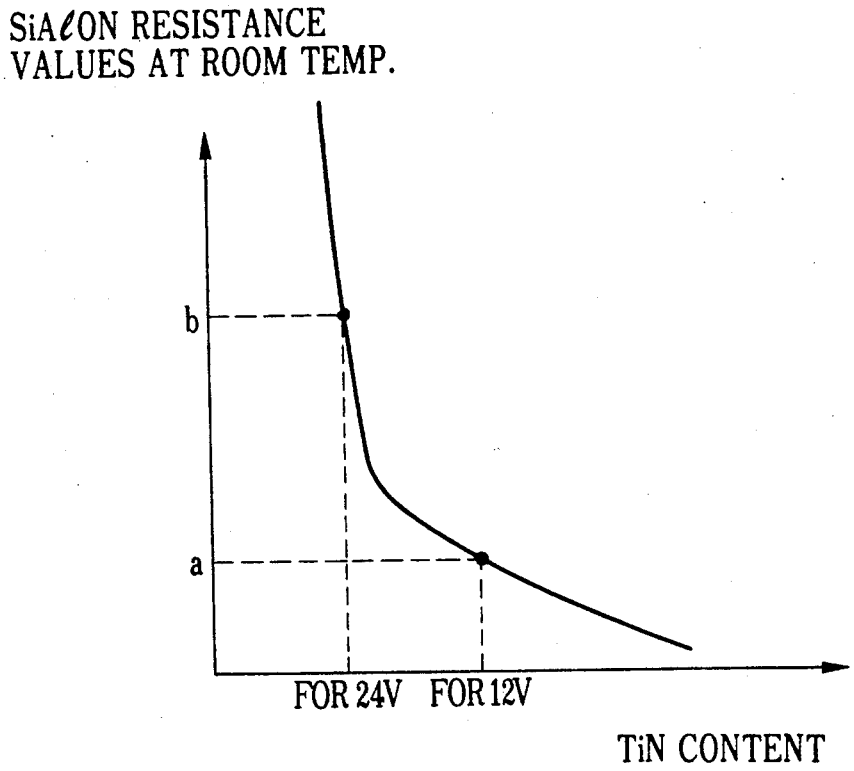
FIG. 9 is a graph showing SiAlON resistance values at room temperature as a function of TiN contents.

The present invention is not limited to the structure described above. The shapes, structures and the like of the components of the preheating apparatus may be arbitrarily changed and modified. In the above embodiment, two pairs, i.e., four glow plugs ① and ④ attached to a 4-cylinder diesel engine are connected in parallel with each other. The parallel-connected pairs are then connected in series with each other. However, in a 6-cylinder diesel engine, a wiring connection structure shown FIG. 7 or 8 may be employed. That is, six glow plugs are connected such that every three of them are connected in parallel with each other, and one set of the three parallel-connected glow plugs are connected to the other set of the remaining three parallel-connected glow plugs. Alternatively, two glow plugs are connected in series with each other, and three sets of series-connected plugs are connected in parallel with each other. In the former case, the upsteam glow plugs①②③ are constituted by bipolar glow plugs. In the latter case, the glow plugs①③ and⑤are constituted by the bipolar glow plugs. In either case, the remaining glow plugs④⑤and⑥or②④and⑥may be constituted by the unipolar or bipolar glow plugs. In the structures in FIG. 7 and 8, the unipolar glow plugs 10B are used as downstream glow plugs.

In the diesel engine preheating apparatus according to the present invention, one of at least two glow plugs connected in parallel with the engine head is constituted by a bipolar structure having the first and second external connecting terminals at its rear end side while the rear-side external connecting terminals are respectively held by the terminal connecting plate made of a conductive material. This first external connecting terminal is connected to the corresponding second terminal connecting plate integrally assembled to the terminal connecting plate through the insulating members and connected to the battery. At the same time, the second terminal connecting terminal is connected to the terminal connecting plate. The one of the glow plugs is connected in series with the other glow plug connected to the external connecting terminal through the terminal connecting plate. Therefore, a low-cost wiring structure can be obtained in a simple construction. In addition, the second terminal connecting plate is fitted in one terminal connecting plate through the insulating members. Therefore, the engine room can be efficiently used.

What is claimed is:

1. A device for facilitating electrical interconnection of a plurality of body grounded glow plugs arranged in corresponding cylinder chambers of a multi-cylinder diesel engine, the plurality of glow plugs including at least one unipolar glow plug having a central external connecting terminal and at least one bipolar glow plug having first and second external connecting terminals, said device comprising:

a first terminal connecting plate having a central body portion and a pair of end portions each provided with an aperture, each one of said apertures being sized to receive the first external connecting terminal of a bipolar glow plug, said apertures being spaced to accommodate the separation distance between the first external connecting terminals of a pair of bipolar glow plugs when installed in a diesel engine;

a second terminal connecting plate having a body portion with a longitudinally extending opening terminating at opposite ends thereof adjacent thin-walled inwardly offset portions o said body portion, said opening being sized to receive said first terminal connecting plate; and insulating means interposed between said first and second terminal connecting plates for providing electrical isolation therebetween, said inwardly offset lower portions of said second terminal connecting plate providing electrical connection to the second external connecting terminal of a bipolar glow plug when secured thereto.

2. The invention of claim 1 wherein the central body portion of said first terminal connecting plate is thicker than the end portions thereof.

3. The invention of claim 1 wherein the central body portion of said first terminal connecting plate has a thickness substantially equal to the thickness of said second terminal connecting plate.

4. The invention of claim 1 wherein said insulating means includes first and second insulating spacers interposed between the end portions of said first terminal connecting plate and the inwardly offset portions of said second terminal connecting plate.

5. The invention of claim 4 wherein each of said insulating spacers includes a body portion with an upstanding wall having an inner perimeter formed to receive one of said pair of end portions of said first terminal connecting plate and an outer perimeter formed to be accommodated by one of the ends of said opening in said second terminal connecting plate.

6. The invention of claim 5 wherein each of said end portions of said first terminal connecting plate has an enlarged external wall portion and a narrowed neck portion joined to said central body portion; and wherein said upstanding wall of each of said insulating spacers has a gap for accommodating said neck portion.

7. The invention of claim 1 wherein said second terminal connecting plate further includes a plurality of spaced connecting terminal apertures formed in the body portion thereof and sized to receive the central external connecting terminal of a unipolar glow plug.

8. The invention of claim 7 wherein said spaced connecting terminal apertures formed in the body portion of said second terminal connecting plate are spaced to accommodate the separation distance between the central external connecting terminals of a pair of unipolar glow plugs when installed in a diesel engine.

* * * * *